US006220990B1

(12) United States Patent
Crivello

(10) Patent No.: US 6,220,990 B1
(45) Date of Patent: Apr. 24, 2001

(54) JUMPING JACK EXERCISE MACHINE

(76) Inventor: James P. Crivello, 15018 189th Ave., Woodinville, WA (US) 98072

( * ) Notice: Subject to any disclaimer, the term of this patent is extended or adjusted under 35 U.S.C. 154(b) by 0 days.

(21) Appl. No.: 09/502,510

(22) Filed: Feb. 11, 2000

Related U.S. Application Data

(60) Provisional application No. 60/120,025, filed on Feb. 12, 1999.

(51) Int. Cl.[7] ..... A63B 21/00

(52) U.S. Cl. ..... 482/51; 482/70; 482/148

(58) Field of Search ..... 482/51, 53, 54, 482/70, 111, 112; 434/247, 255; 601/33, 35

(56) References Cited

U.S. PATENT DOCUMENTS

Re. 36,031 * 1/1999 Piaget et al. ..... 482/51
5,603,675 * 2/1997 Wu ..... 482/52
5,681,244 * 10/1997 Hsieh ..... 482/51
5,876,307 * 3/1999 Stearns et al. ..... 482/51
6,042,510 * 3/2000 Miller ..... 482/51

* cited by examiner

*Primary Examiner*—Jerome W. Donnelly
(74) *Attorney, Agent, or Firm*—Bracewell & Patterson, LLP; James E. Bradley

(57) ABSTRACT

An exercise machine for low impact exercise of a person. The machine has a base and a support post extending from the rearward end of the base. Two leg members divergently extend generally downward from a first forward facing pivot point for pivoting about a first axis perpendicular to the support post. A planar foot support is on each leg member and extends forward from the support post. Two arm members divergently extend generally upward from a second forward facing pivot for pivoting about a second axis parallel to the first axis. A handle is on each arm member. The arm members are pivotally joined to the leg members and the second axis slides vertically in engagement with the support post.

23 Claims, 6 Drawing Sheets

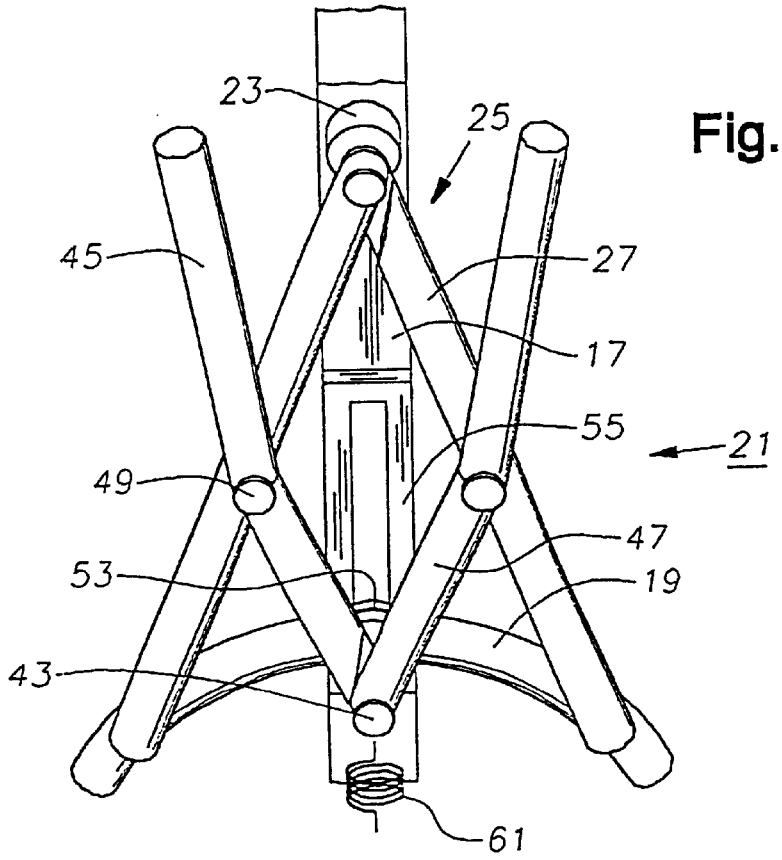
Fig. 3
Fig. 4
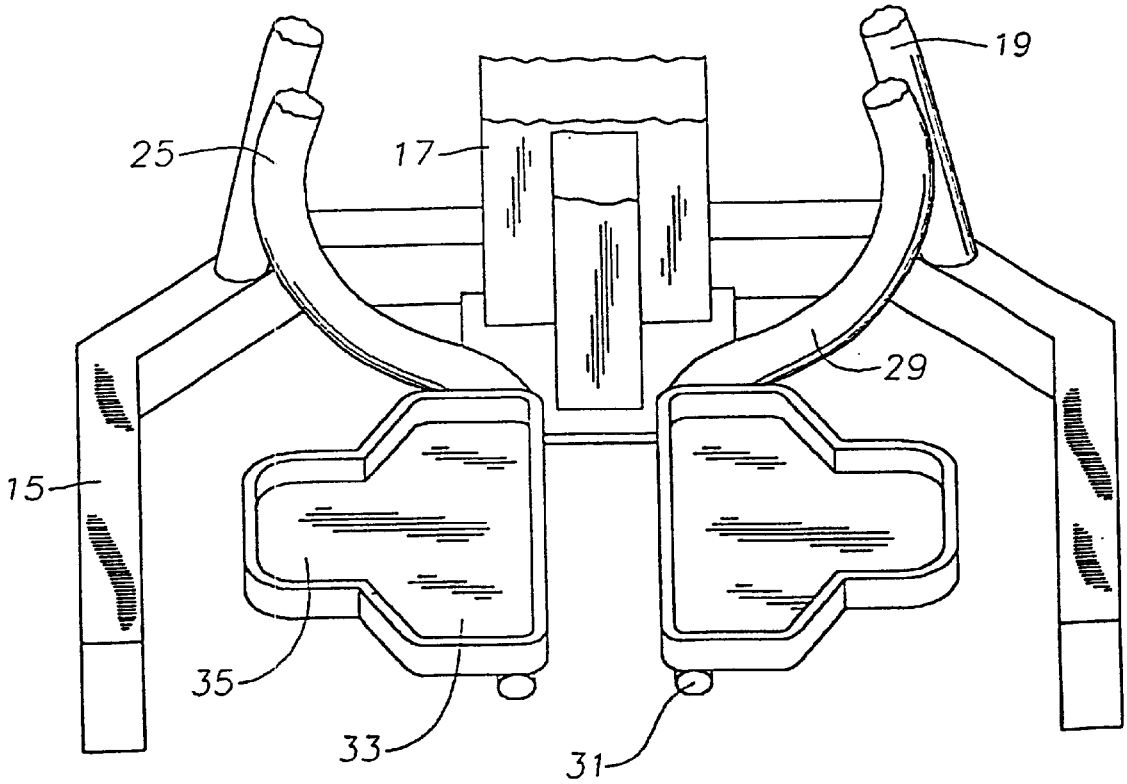

JUMPING JACK EXERCISE MACHINE

CROSS-REFERENCE TO RELATED APPLICATIONS

This application claims the benefits of provisional patent application serial No. 60/120,025, filed on Feb. 12, 1999 in the United States Patent & Trademark Office.

TECHNICAL FIELD

This invention relates in general to fitness equipment and in particular to an aerobic exercise machine which simulates low impact jumping jack-type motions.

BACKGROUND OF THE INVENTION

Because of a growing appreciation for the benefits of regular exercise and because constraints of time and space prevent many persons from indulging in activities such as running, swimming and walking, the market for exercise equipment is rapidly increasing. It is generally desirable to exercise a number of different muscles over a fairly large range of motion so as to provide for even physical development and a maximum level of exercise. It is further desirable that exercise equipment provide a smooth, relatively natural motion so as to avoid jarring or irregular strains which can damage muscles and joints. It is also desirable that exercise equipment be relatively easy to use and of simple, low cost construction.

While a number of different exercise systems are known in the prior art, such systems suffer from a number of shortcomings which limit their utility. Stationary bicycles are widely used; however, they are employed in a sitting position and consequently, the number of muscles exercised is small. Furthermore, the range of motion provided by a stationary bicycle is fairly limited. Stationary devices for simulating cross country skiing are also in widespread use. While these systems exercise more muscles than do stationary bicycles, the relatively flat, shuffling foot motion provided thereby does not adequately exercise all of the leg muscles through a wide range of motion. Further, those with provisions for arm movement require a learned balance and thus are not easy to use. Stair climbing equipment which also has become popular, exercises only the lower body. Treadmills and the like permit walking or jogging, but are jarring to knee and ankle joints and like cross country skiing devices, require a learned balance. Thus, they are not easy to use.

There is a need for an exercise device which is simple, easy use and which provides for a smooth low impact exercise that uses a relatively large number of muscles through a large range of motion.

SUMMARY OF THE INVENTION

This invention is directed towards a machine for low impact personal exercise that is simple, easy to use, and works a relatively large number of muscles through a large range of motion. The machine has a base with a support post extending vertically upward from its rearward end. A foot support is positioned perpendicular to the support post and above the base. The foot support pivots on a forward facing pivot mounted to the support post about a first axis that is generally perpendicular to the post. A handle is pivotally mounted to the support post at a second forward facing pivot and rotates about a second axis parallel to the first. The first pivot point is higher than the second pivot point. The handle is pivotally joined to the foot support and the second pivot can slide vertically in engagement with the support post. Resistance is provided by an electromagnetic coil that resists the vertical sliding of the second pivot point. The foot support is generally planar and adapted to accept a human foot in an axis parallel to the first axis and an axis perpendicular to the first axis. The person is supported on the foot supports above the base. The handle is extensible along a line perpendicular to the first axis and rotatable about an axis perpendicular to the first axis.

BRIEF DESCRIPTION OF DRAWINGS

FIG. 3 is an enlarged front view of a center portion of the machine of FIG. 1.

FIG. 4 is an enlarged front view of a lower portion of the machine of FIG. 1.

BEST MODE FOR CARRYING OUT THE INVENTION

Figure 1:
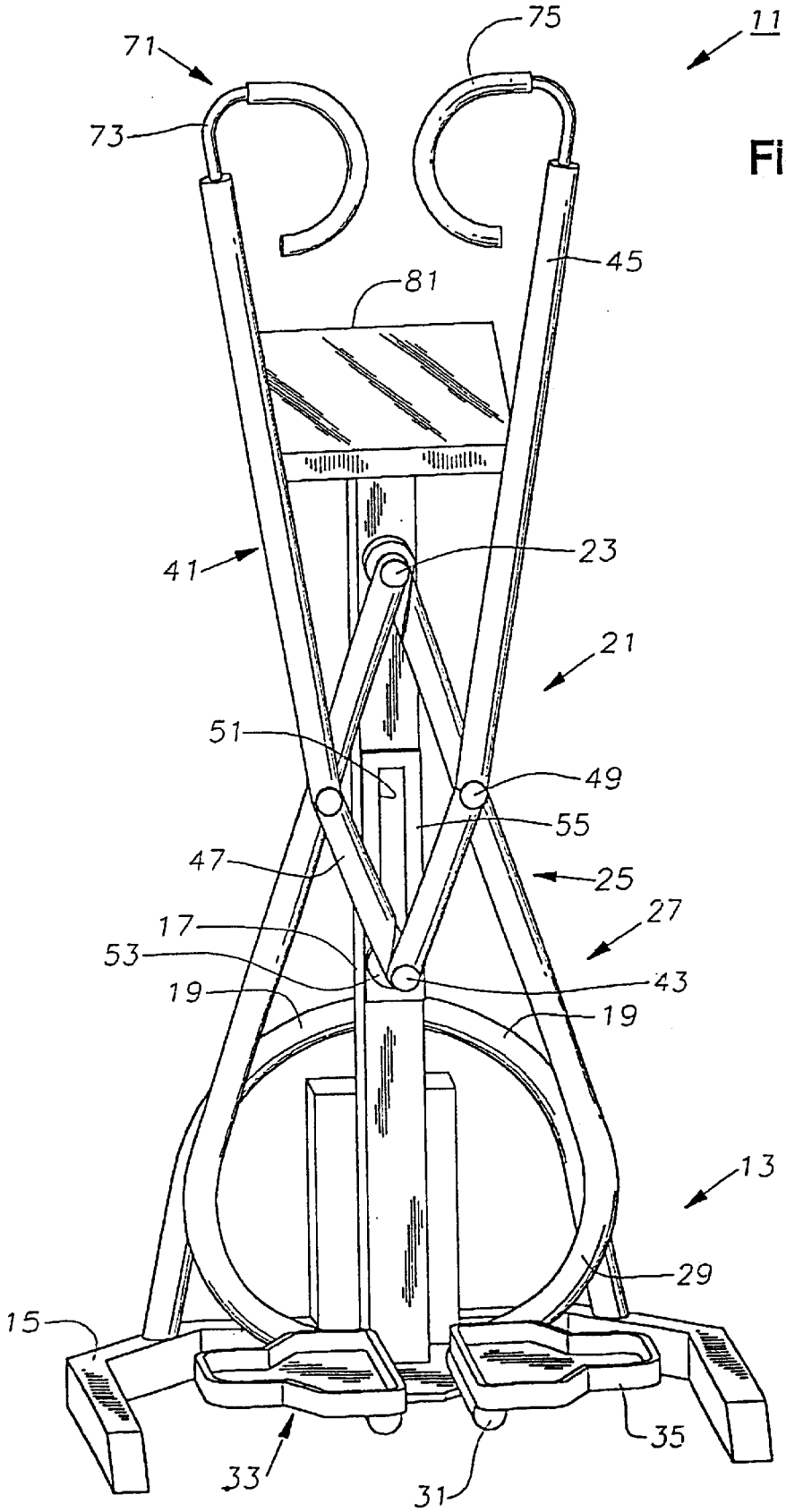
FIG. 1 is a front view of an exercise machine constructed in accordance with the invention.
Figure 2:
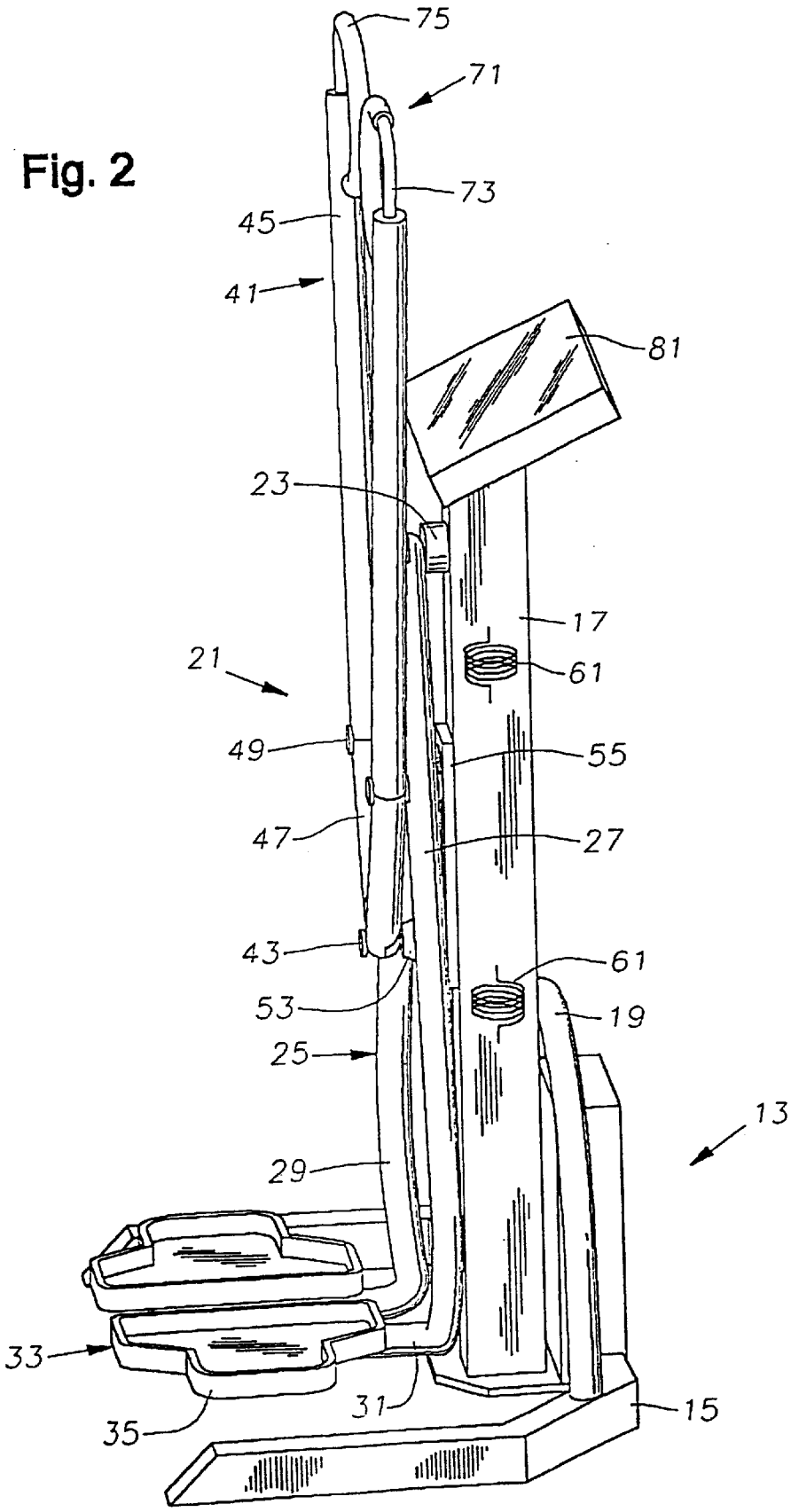
FIG. 2 is a side view of the machine of FIG. 1.

Referring to FIGS. 1 and 2, an aerobic exercise machine 11 is shown. Machine 11 has a tubular steel frame 13 with a horizontal, U-shaped base 15 and a vertical, central support post 17 extending upward from a rearward end of base 15. Base 15 rests on a floor-type support surface. Central post 17 is approximately four feet in height and is reinforced and supported on both sides by curved side posts 19 which extend between it and base 15.

Machine 11 has a linkage assembly 21 suspended from a stationary support axle 23 located near an upper end of central post 17. Upper axle 23 is perpendicular to and extends forward a short distance from central post 17. Assembly 21 has a pair of substantially diagonal leg sections or legs 25 whose upper ends are pivotally mounted together to upper axle 23. Legs 25 have straight upper portions 27 which diverge outward relative to each other in a downward direction. The lower portions 29 of legs 25 curve back inward toward one another at their lower ends.

Figure 7:
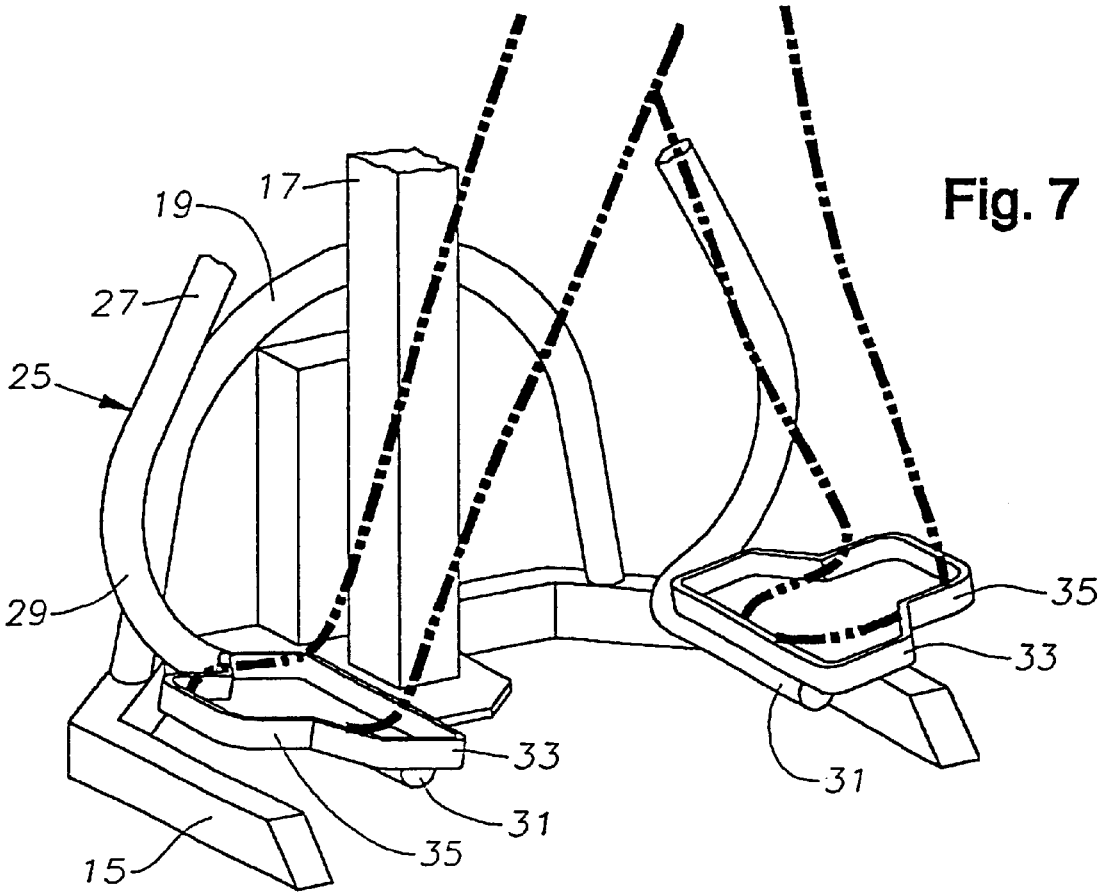
FIG. 7 is an enlarged front view of an alternate positioning for a user of the machine of FIG. 1.

As shown in FIGS. 4 and 7, a foot bar 31 extends horizontally forward from and substantially perpendicular to the lower end of each leg 25 such that foot bars 31 are substantially parallel to and much longer than upper axle 23. A foot support assembly 33 is rigidly mounted to each foot bar 31. Each foot support assembly 33 comprises an oversized, planar foot platform having a laterally extending, side platform 35 on at least one of its sides. In the embodiment shown, foot support assemblies 33 have a textured upper surface and/or padding for improved footing and comfort for the user. Assemblies 33 remain substantially fixed relative to legs 25 throughout a range of motion which will be described below.

Again referring to FIG. 1, linkage assembly 21 also comprises a pair of substantially vertical arm sections or arms 41 whose lower ends are pivotally mounted together to a lower axle 43 that is below axle 23. Like legs 25, arms 41 have straight upper portions 45 which diverge from each other in an upward direction. The lower portions 47 of arms 41 curve back inward toward one another at their lower ends where they are joined to axle 43. Each arm 41 is pivotally connected to its adjacent leg 25 at a pivot point 49. Pivot points 49 lie at the intersection of upper and lower portions 45, 47 on arms 41, and near the middle of upper portions 27 on legs 25. Pivot points 49 interlock arms 41 and legs 25 together such that one cannot move without moving the others.

Unlike upper axle 23, which is rigidly mounted to central post 17, lower axle 43 is floating, or slidably mounted to central post 17. The rearward end of axle 43 is located in a vertical rectangular slot 51 in the middle of post 17 and is limited to vertical movement therein. Axle 43 has a flange 53 (FIGS. 1 and 3) located on each side of slot 51 which prevents axle 43 from slipping out of slot 51 and moving either forward or rearward relative to post 17. The inner and outer surfaces of slot 51 are lined with thin, friction-reducing pads 55 (FIGS. 2 and 3) for facilitating the motion of axle 43 in slot 51.

Assembly 21 is also provided with a mechanical resisting device 61 (shown schematically in FIGS. 2 and 3) located within central post 17 adjacent to slot 51. In the preferred embodiment, device 61 comprises one or more electrical coils which provides variable magnetic resistance to the vertical movement of axle 43. A ferrous member (not shown) is mounted to axle 43 and is influenced by the magnetic field produced by the coil. The resistance is due to eddy currents produced by the coil when energized. Device 61 may also be deactivated so that axle 43 and, thus, assembly 21 is free to move without resistance.

A telescoping handle 71 is slidably and coaxially mounted within the upper end of each arm 41. Handles 71 have a straight tubular shaft 73 that transitions into a generally circular grip 75 which is covered or coated with a soft, nonslip material. Shafts 73 extend into the straight upper portions 45 of arms 41 and are readily movable and rotatable relative thereto.

Machine 11 may also be equipped with an optional monitoring and control system 81 which, in the embodiment shown, is mounted to an upper end of central post 17. System 81 may perform many operations including monitoring the user's cardiovascular system. System 81 may also be programmed for a particular work-out regimen to assist the user during his exercise routine.

Figure 5:
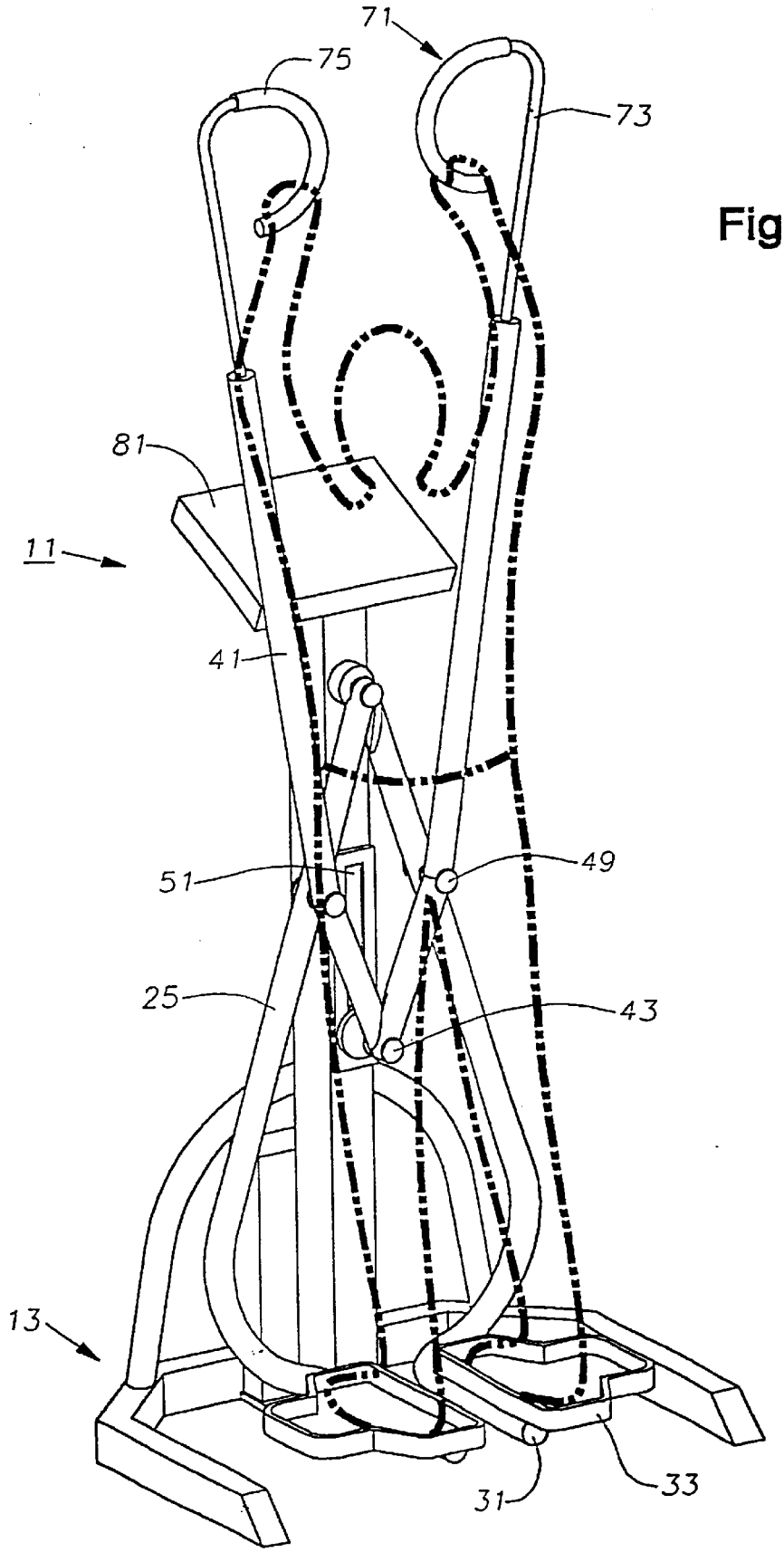
FIG. 5 is a front isometric view of the machine of FIG. 1 in a starting position of operation.

In operation, with one type of exercise, a user (shown in phantom in FIGS. 5–7) faces toward machine 11 and grasps a handle 71 with each hand. The user then places one foot on each foot support 33 so that his feet are substantially parallel to foot bars 31. The handles 71 are extended from arms 41 to a comfortable distance such that the user's arms are straight and above his head but relaxed. The user's legs and feet should be slightly separated as if the user was standing upright. The user is now ready to begin exercising with machine 11.

By moving his legs and feet apart while keeping his legs relatively straight, and simultaneously spreading his arms apart while they are straight, the user will move arms 41 and legs 25 in a coordinated, scissor-like motion. The user is essentially performing a jumping jack-type motion during this operation while his torso remains relatively stationary. The handles 71 are free to extend, retract or rotate based on the most comfortable position for the user. Pivot points 49 cause arms 41 and legs 25 to move like linkages as axle 43 moves up and down in slot 51. The user may repeat this motion as many times as needed to perform his exercise regimen. The resistance provided by the electrical coil may be varied to suit the individual user, however, the user controls his speed, amplitude and duration of motion.

Figure 6:
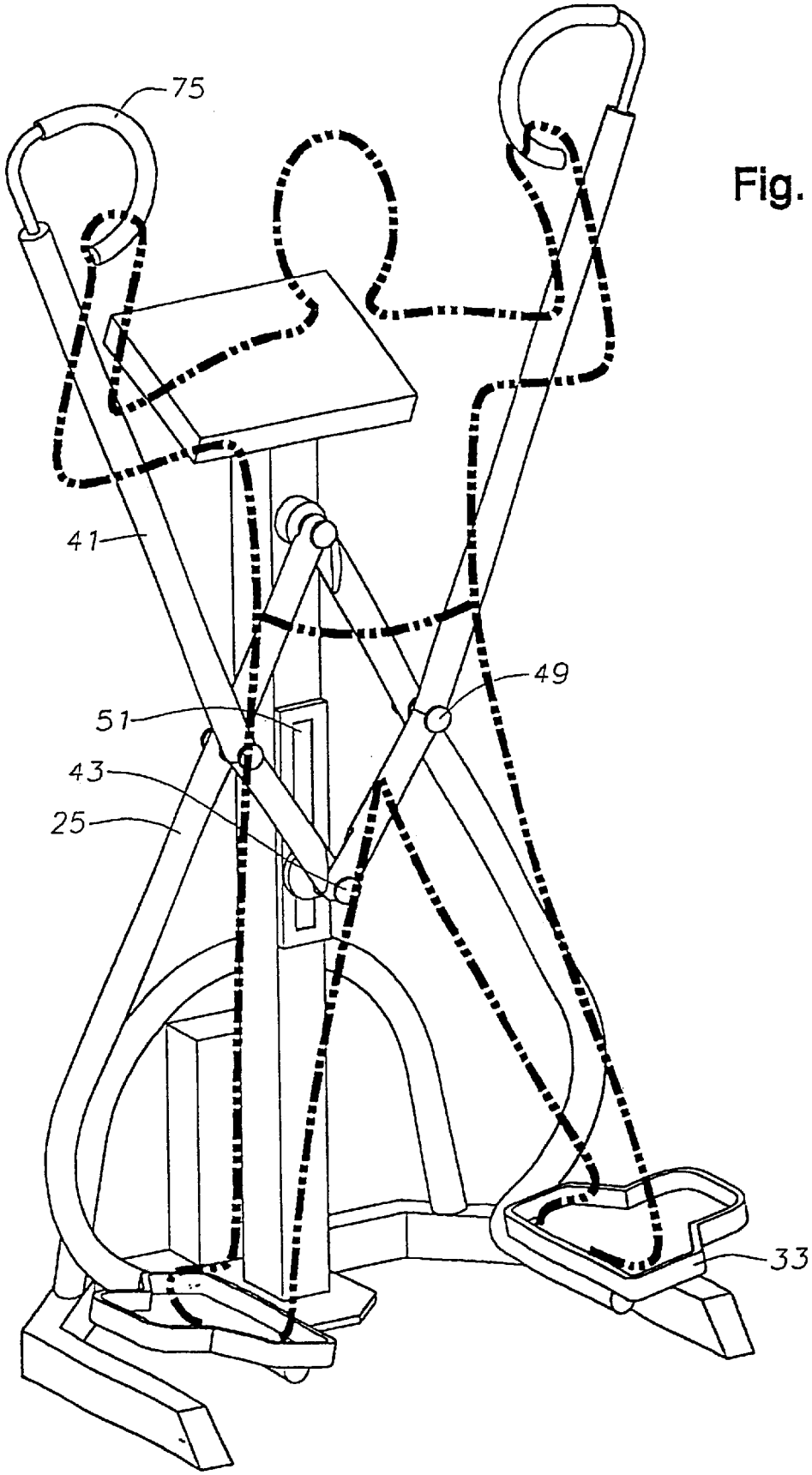
FIG. 6 is a front isometric view of the machine of FIG. 1 at an intermediate position of operation.

During operation, arms 41 and legs 25 move between relatively vertical configurations in a collapsed position (FIG. 5), and much more diagonal configurations in an extended position (FIG. 6). The four pivot points provided by axles 23, 43 and pivot points 49 synchronize the movements of handles 71 and foot supports 33 while maintaining foot supports 33 at anatomically correct angles relative to the torso of the user throughout their range of motion. Since legs 25 are entirely supported at axle 23, there is very little if any impact on the body or joints of the user as legs 25 merely pivot about axle 23. As shown in FIG. 7, the user may shift his feet diagonally or sideways so that they overlie supports 33 and 35. This positioning gives the user a slightly different workout. In another method, the user may face away from machine 11. Other exercises may be performed with the machine.

The exercise machine of this invention has several significant advantages. It allows for continuous, low impact exercise, and therefore reduces the chances of injury to the user's joints and muscles. Using the machine is easy and does not require a learned balance. Also, the machine works desirable muscle groups not easily worked by other low impact exercises or exercise machines. It can be used in a variety of ways to work various muscle groups through out a large range of motion. The machine itself is compact and does not require a large floor area in which to store. Finally, it incorporates a smooth, adjustable resistance mechanism which is adaptable for various fitness levels.

While the invention has been shown or described in only some of its forms, it should be apparent to those skilled in the art that it is not so limited, but is susceptible to various changes without departing from the scope of the invention. For example, the handles may be mounted stationarily rather than to the arms.

What is claimed is:

1. An exercise machine for low impact exercise of a person comprising:

a base;

a support post extending vertically upward from said base;

a pair of legs mounted to said post at a fixed pivot point and depending downward;

a pair of arms mounted to said post at a floating pivot located below said fixed pivot point, each of said arms extending upward and being pivotally connected to one of said legs; and a foot support at a lower end of each of said legs for supporting a user's foot, wherein moving said foot supports away from and toward each other causes said floating pivot point to reciprocate up and down said post.

2. Said exercise machine of claim 1 wherein said base has a forward end and a rearward end and said support post extends vertically from said rearward end.

3. Said exercise machine of claim 1 further comprising a resistance device mounted to said post for providing resistance to said upward and downward movement of said floating pivot.

4. Said exercise machine of claim 3 wherein said resistance device comprises an electromagnetic force.

5. Said exercise machine of claim 1 wherein said foot support is generally planar and adapted to accept a human foot both in a first axis and in a second axis perpendicular to said first axis.

6. Said exercise machine of claim 1 further comprising handles pivotally mounted to an upper end of each of said arms for gripping by a user.

7. Said exercise machine of claim 6 wherein each of said handles telescopes relative to one of said arms.

8. Said exercise machine of claim 6 wherein each of said handles is rotatable relative to one of said arms.

9. Said exercise machine of claim 1 wherein said legs have upper portions that diverge from each other in a downward direction and lower portions that converge toward each other in a downward direction.

10. Said exercise machine of claim 1 wherein said arms diverge from each other in an upward direction.

11. Said exercise machine of claim 1 wherein said post has a vertical slot and said floating pivot is a pin that slides up and down said slot.

12. An exercise machine for low impact exercise of a person comprising:

a base;

a support post extending vertically upward from said base;

a pair of legs mounted to said post at a fixed pivot point and depending downward;

a pair of arms mounted to said post at a floating pivot located below said fixed pivot point, each of said arms extending upward and being pivotally connected to one of said legs;

a foot support at a lower end of each of said legs for supporting a user's foot, wherein moving said foot supports away from and toward each other causes said floating pivot point to reciprocate up and down said post;

a resistance device mounted to said post for providing resistance to said upward and downward movement of said floating pivot; and a handle pivotally mounted to an upper end of each of said arms for gripping by said user.

13. Said exercise machine of claim 12 wherein said base has a forward end and a rearward end and said support post extends vertically from said rearward end.

14. Said exercise machine of claim 12 wherein said resistance device comprises an electromagnetic force.

15. Said exercise machine of claim 12 wherein said foot support is generally planar and adapted to accept a human foot both in a first axis and in a second axis perpendicular to said first axis.

16. Said exercise machine of claim 12 wherein each of said handles telescopes relative to one of said arms.

17. Said exercise machine of claim 12 wherein each of said handles is rotatable relative to each of said arms.

18. Said exercise machine of claim 12 wherein said legs have upper portions that diverge from each other in a downward direction and lower portions that converge toward each other in a downward direction.

19. Said exercise machine of claim 12 wherein said arms diverge from each other in an upward direction.

20. Said exercise machine of claim 12 wherein said post has a vertical slot and said floating pivot is a pin that slides up and down said slot.

21. A method of exercising comprising said steps of:

providing an exercise machine having;

a base;

a support post extending vertically upward from said base;

a pair of legs mounted to said post at a fixed pivot point and depending downward; a pair of arms mounted to said post at a floating pivot located below said fixed pivot point, each of said arms extending upward and being pivotally connected to one of said legs; and a foot support at a lower end of each of said legs for supporting a user's foot, wherein moving said foot supports away from and toward each other causes said floating pivot point to reciprocate up and down said post;

standing on said foot supports with a foot on each foot support;

positioning a hand on each of said handles;

moving said feet and legs apart from each other in unison causing said foot supports and handles to move toward and apart from each other; and resisting said movement of said foot supports and said arms with a resistance device mounted to said support post.

22. Said method of claim 21 wherein said step of standing on said foot supports further comprises said step of facing said post with said feet perpendicular to said plain of motion.

23. Said method of claim 21 wherein said step of standing on said foot supports further comprises said step of facing laterally relative to said post with said feet parallel to said plane of motion.

* * * * *